US005128718A

United States Patent [19]

Mizoguchi

[11] Patent Number: 5,128,718

[45] Date of Patent: Jul. 7, 1992

[54] IMAGE FORMING APPARATUS RESPONSIVE TO AMBIENT CONDITION DETECTING MEANS

[75] Inventor: Yoshito Mizoguchi, Yokohama, Japan

[73] Assignee: Canon Kabushiki Kaisha, Tokyo, Japan

[21] Appl. No.: 575,801

[22] Filed: Aug. 31, 1990

[30] Foreign Application Priority Data

Aug. 31, 1989 [JP] Japan ..... 1-225375

[51] Int. Cl.[5] ..... G03G 21/00

[52] U.S. Cl. ..... 355/208; 355/214; 355/246

[58] Field of Search ..... 355/205, 207, 208, 214, 355/246, 215, 30

[56] References Cited

U.S. PATENT DOCUMENTS

| | | | |
|---|---|---|---|
| 4,502,777 | 3/1985 | Okamoto et al. | 355/208 |
| 4,879,576 | 11/1989 | Naito | 355/214 |
| 4,888,618 | 12/1989 | Ishikawa | 355/208 |
| 4,989,039 | 1/1991 | Hayashi et al. | 355/208 |
| 5,034,772 | 7/1991 | Suzuki | 355/208 |
| 5,049,939 | 9/1991 | Koichi | 355/246 |
| 5,057,867 | 10/1991 | Ishigaki et al. | 355/208 |

FOREIGN PATENT DOCUMENTS

| | | | |
|---|---|---|---|
| 0073055 | 6/1979 | Japan | 355/214 |
| 0010170 | 1/1982 | Japan | 355/214 |
| 0205179 | 8/1989 | Japan . | |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image forming apparatus is disclosed which is capable of controlling the quality of the images formed in accordance with detected environmental conditions. This is accomplished in the invention through the use and control of predetermined values which are dependent upon the detected environmental state. A correcting device corrects the predetermined value based on results detected by an image density detecting sensor, whereby the correcting amounts are varied in accordance with the detected environmental state. A constant image density is always obtained regardless of variations in the inner environment of the image formation system.

22 Claims, 7 Drawing Sheets

| ΔD | CORRECTION PARAMETERS |
|---|---|
| -0.24~-0.16 | -2 |
| -0.14~-0.06 | -1 |
| -0.05~0.05 | 0 |
| 0.06~0.14 | 1 |
| 0.15~0.24 | 2 |

| ΔD | CORRECTION PARAMETERS |
|---|---|
| -0.24~-0.16 | -2 |
| -0.14~-0.06 | -1 |
| -0.05~0.05 | 0 |
| 0.06~0.14 | 1 |
| 0.15~0.24 | 2 |

IMAGE FORMING APPARATUS RESPONSIVE TO AMBIENT CONDITION DETECTING MEANS

BACKGROUND OF THE INVENTION

1. Field of the Invention

The present invention relates to a copying machine using an electrophotographic technology, LBP and other image formation system, and the multicolored image formation system with two or more colors.

2. Related Background Art

FIG. 2 is a block diagram for the image forming system, whereby the conventional environmental control and its correction method are explained. Here described is a case where the present invention is used for a laser beam printer, that is, the mechanism of forming images by scanning a laser beam on the photosensitive drum in synchronization with reading of an original will be explained below.

First, an original 9 is read by a CCD 1. The obtained analog image signal is amplified to a given level by an amplifier 2, and then converted into an 8-bit digital image signal (0 to 255 gradation) by a A/D converter 3. Next, the digital image signal passes through a gamma ($\gamma$) converter 10 (gradation control table containing a 256 type RAM) for gamma correction, and then enters a D/A converter 14.

The digital signal is converted into an analog signal again. Then, the comparator 16 compares the analog signal with a signal of a specific frequency which is generated by a triangular wave generator 15. Then, the pulse width is modulated. The binary coded image signal whose pulse width has been modulated enters the laser drive circuit 17 as it is, which is used as an emission ON/OFF control signal for the laser diode 18. A laser beam emitted from the laser diode 18 is scanned in main scanning direction by a known polygonal mirror 19. Then, after passing through the f/$\theta$ lens 20 and reflection mirror 21, the beam is irradiated on the photosensitive drum 22 or an image supporting or bearing material which is rotating in direction shown by arrow to thereby form an electrostatic latent image.

On the other hand, the photosensitive drum 22 is uniformly discharged by the exposure unit 28, and charged uniformly with negative electricity by the electrostatic charger 23. After that, when the photosensitive drum receives a laser beam mentioned above, it forms an electrostatic latent image on its surface according to the image signal. In addition, the so-called image scanning method or a method of exposing the portion to be developed (black pixels) is employed as usually so in the laser beam printer. Therefore, the developing unit 24 uses the known reverse development method to adhere toner with a negative charge characteristic to the portion of the photosensitive drum 22 discharged by laser. Thus, the latent image becomes visible.

FIG. 3 shows the relations between the surface potential of the photosensitive drum and the development contrast when the said reverse development is performed. Here, $V_D$ represents the negative potential charged uniformly by the charger 23 shown in FIG. 2. $V_{OO}$ represents the potential obtained when the laser diode is driven with the image signal of $OO_H$ ($\theta$ level) which has been digitized. Potential on the surface of the photosensitive drum $V_{FF}$ is the potential obtained in the same way as mentioned above for $FF_H$ (256 levels). Therefore, assuming that $|V_{DEV}-V_{FF}|$ as shown in FIG. 3 is contrast potential Vcont and the development density developed with Vcont is Dmax, the Vcont should be set appropriately to optimize image density (generally, approximately 1.2 to 1.8 in electrophotography). (In general, Vcont may be $|V_D-V_{FF}|$).

It should be noted that the background removing potential (Vback) in FIG. 3 is used to fully remove the fog or background from a white-ground portion of an image which is irradiated with light quantity $OO_H$.

The visible image formed on the photosensitive drum 22 according to the procedure mentioned above (a toner image with negative charge) is transferred to a recording material (paper, in general) 26. The remaining toner on the photosensitive drum 22 is scraped off by the cleaner 27 later. Then, said series of processes is repeated again.

For a laser beam printer with the configuration mentioned above, the conventional environmental control varies the contrast potential mentioned previously (Vcont) depending on the environment so that an optimal image density can be output constantly. That is to say, as shown in FIG. 4, if the development characteristic (V-D curve) varies with the environment as A for high humidity, B for normal humidity, and C for low humidity, Vcont is changed to Vcont-a for high humidity, Vcont-b formal humidity, and Vcont-c follow humidity as shown in FIG. 5. Thus, Dmax will be constant at 1.5 regardless of the environment.

To realize the environmental control, a temperature/humidity sensor 11 is provided as shown in FIG. 2. According to the absolute humidity detected and the Vcont table of the solid lines in FIG. 5 that is stored in memory 13, the CPU 12 calculates a proper Vcont value to change the amount of charge in the charger 23.

The environmental dependency of the V-D curve shown in FIG. 4 varies with the humidity adjustment state of developer in the developing unit. The temperature/humidity sensor 11 is, therefore positioned near the developing unit 24 so that the humidity adjustment state of developer can be well reflected on the sensor. However, even with such control, Dmax dependent on the environment is not always constant at 1.5 due to the machine type, the deterioration of the developer or minor difference in the production lot of developer. Namely, Dmax may become constant at 1.6 or 1.4.

To correct these variations, a correction means that adds or subtracts a certain amount of correction to or from the previously mentioned Vcont in all environments has been devised. Namely, a means to shift the Vcont table in FIG. 5 vertically by parallel movement has been made available. This correction has been provided, for instance, as a correction means used when the V-D curve changes in any environment from A, B, or C to A', B', or C' as shown in FIG. 6 along with the deterioration of developer or difference in the production lot number, or as a correction means used when the aimed Dmax cannot be obtained due to the distance between the development sleeve and photosensitive drum, or the difference in the amount of developer on the sleeve.

However, as mentioned above, such a way of correction that a certain amount of correction is added (or subtracted) to the function shown in FIG. 5 has drawback of spoiling the stability of Dmax achieved by the said environmental control.

To be more specific, if the V-D curve indicating development characteristic is changed from A, B, or C to A', B', or C' because of the deterioration of developer or delicate differences in the characteristics of developer for a machine having environmental variations shown in FIG. 4, or if a machine is produced in the way that it will have a characteristic represented with the V-D curve of A', B', or C' in FIG. 6 instead of the standard V-D curves in FIG. 4, constant Dmax of 1.5 cannot be output with the Vcont table in FIG. 5 intact. Therefore, the table must be corrected to return Dmax to 1.5. For instance, Vcont is added by ΔV to characteristic C' in FIG. 6 so as to obtain 1.5 of Dmax, ΔV of Vcont is also added to A' and B'. Then, the Vcont table is modified to be the dotted line in FIG. 5. As a result, Dmax is not the same in three environments any longer. Namely, Dmax-A'>Dmax-B'>Dmax-C'=1.5. This means that the employment of conventional correction will spoil environmental control for stabilization of density.

This is also true when correction is made to return Dmax to 1.5 based on the V-D curve of A'. In this case, 1.5=Dmax-A'>Dmax-B'>Dmax-C'. This is because the same amount of correction is applied for all environments although the amount of contrast potential necessary to change Dmax differs from environment to environment. Consequently, the conventional correction method has drawback that it is poor at following up the environment.

SUMMARY OF THE INVENTION

This invention is made to overcome the problem mentioned above. It is an object of the present invention to provide a system that can permit constant image density regardless of variations in the inner environment of the system.

The other objectives will be revealed through detail explanation of this invention.

DETAILED DESCRIPTION OF THE PREFERRED EMBODIMENTS

The first embodiment of the presnet invention will be described below.

EMBODIMENT 1

Figure 1:
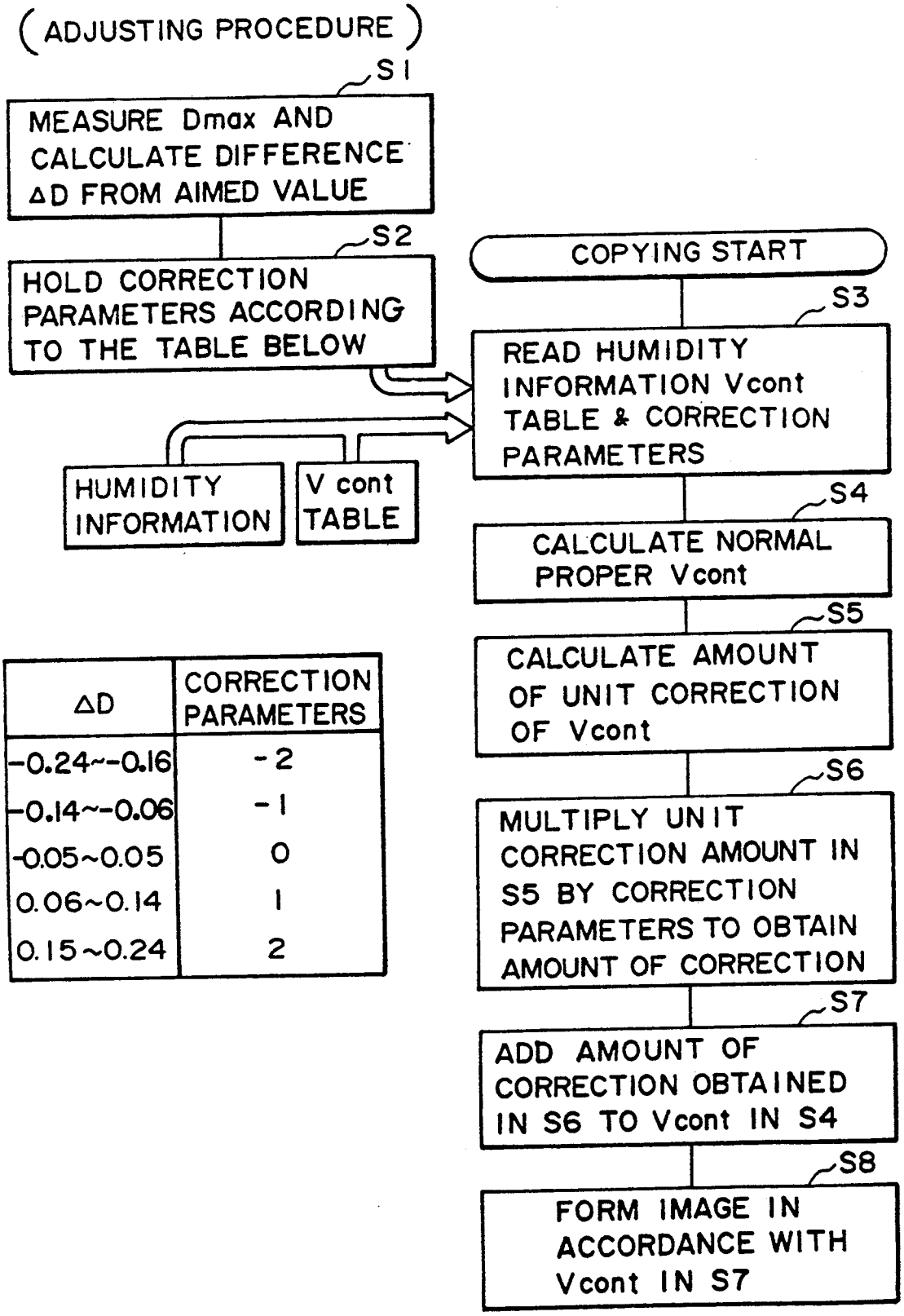
FIG. 1 is a flow chart indicating the adjusting procedure and image forming procedure in the present invention.

Shown on the left of FIG. 1 is an adjusting procedure to set up parameters which indicate the extent of correction to be added if Dmax differs from the target value. On the right, thereof an image formation procedure is described, which outlines how to obtain images with constant Dmax by changing the amount of correction or development contrast according to the environment using the said correction parameters.

Figure 2:
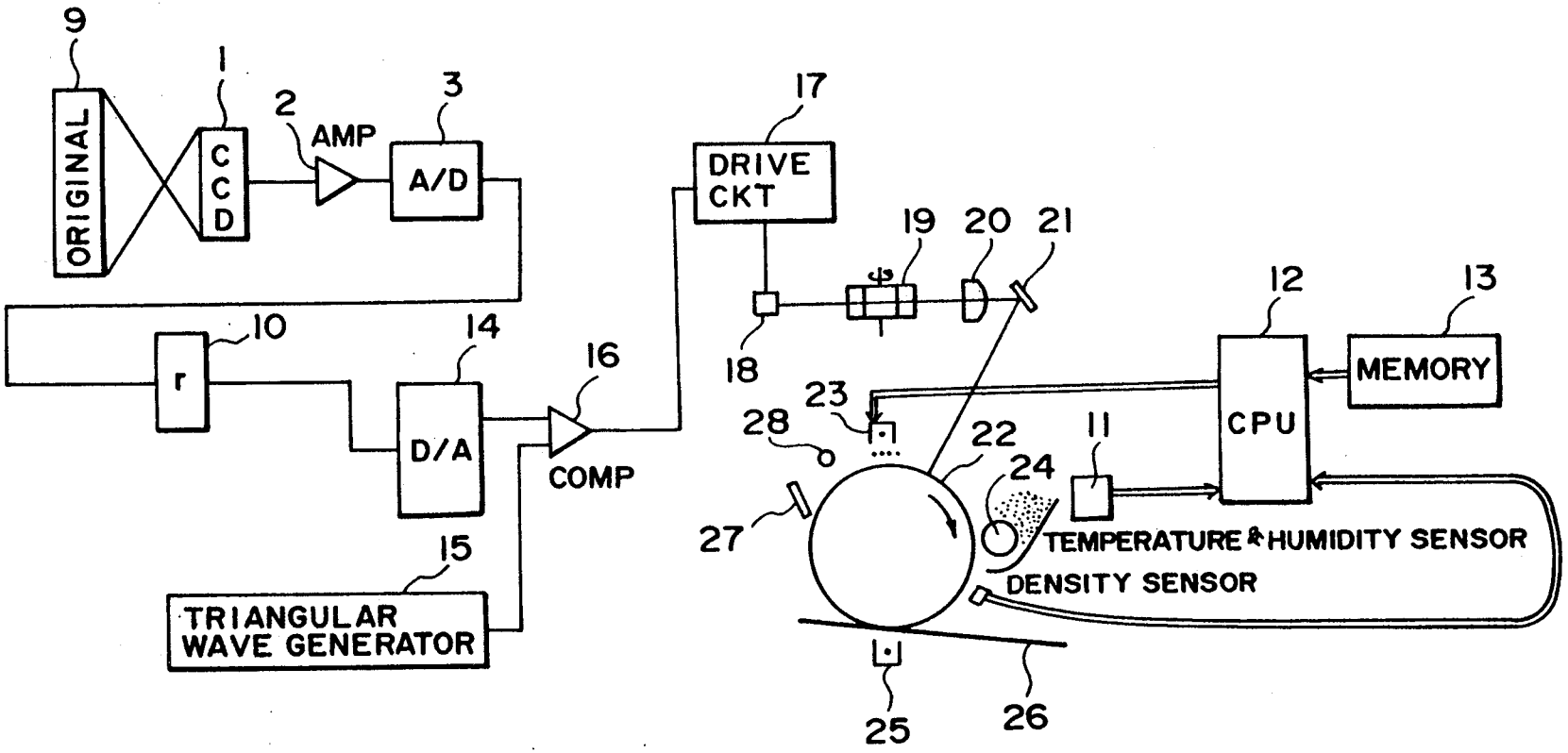
FIG. 2 is a schematic diagram for the image formation system of the present invention.
Figure 3:
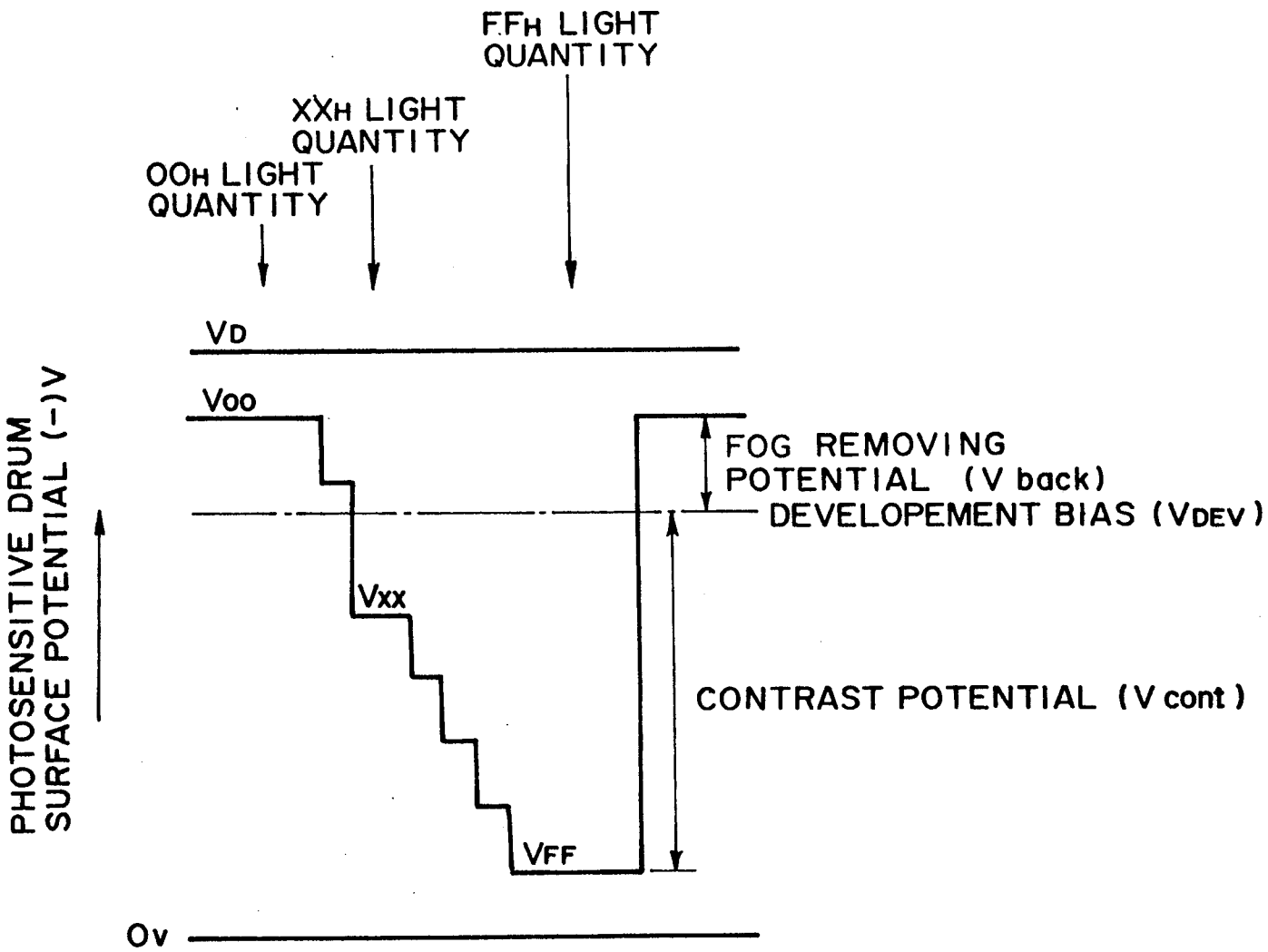
FIG. 3 is an explanatory drawing for the photosensitive drum surface potential and development contrast.

First, Dmax is measured in processing S1 on the left and difference ΔD from the aimed value Dmax is calculated. In processing S2, the correction parameters used to correct ΔD according to the table in FIG. 1 are stored in memory which contains the Vcont table in FIG. 2. The parameters are integers act in units of 0.1 Dmax values and stored together with the signs. After copying has started as shown on the right of FIG. 1, humidity information which the temperature/humidity sensor 11 in the system detects in processing S3, the Vcont table stored in memory 13, and the said correction parameters are read into the CPU 12.

In processing S4, a normal proper Vcont value without correction is calculated based on the said humidity information and Vcont table. After that, the amount of unit correction of Vcont is determined in processing S5. In this example, the amount of unit correction is set to 1/16 of the proper Vcont value calculated in processing S4. Namely, a certain ratio or 1/16 of the proper Vcont value which varies depending on humidity information is set as an amount of unit correction, whereby the amount of correction can be changed according to the environment. Thus, the main purpose of the present invention has been embodied.

Figure 4:
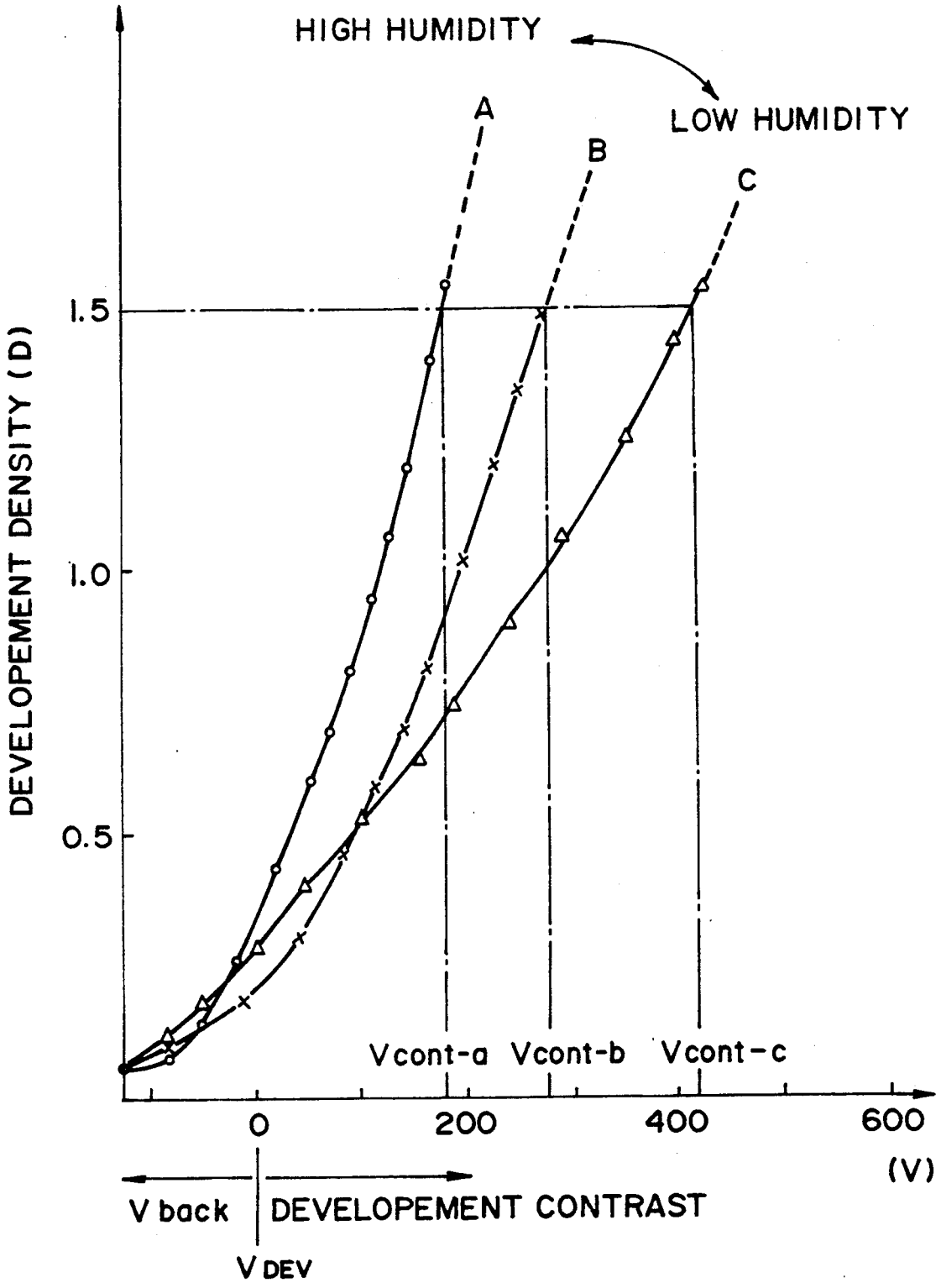
FIG. 4 is a graph that shows the D-V curve indicating the normal development characteristic.

Now, the amount of unit correction or 1/16 of Vcont brings about a difference of approximately 0.1 at Dmax due in the environmental dependency of the V-D curve as shown in FIG. 4. That is to say, at a density of 1.5 on the V-D curve of A, the slope of curve A is approximately 10 V for 0.1 of density, that of curve B approximately 15 V, and that of curve C approximately 25. On the other hand, the proper contrast potentials of A, B, C are shown as 180 V, 280 V, 420 V, respectively in the graph. The 1/16 of these values are approximately 11 V, 17 V, 26 V which agree with the values for 0.1 of density. Therefore, a value obtained by multiplying the proper Vcont value by 1/16 is used as the amount of unit correction per 0.1 of density to correct Dmax.

In processing S6, the correction parameters stored according to the adjustment procedure in SP and read in S3 are applied to the amounts of unit correction obtained as mentioned above. Thus, the necessary amounts of correction are determined. Namely, the amount of unit correction is re-converted into the value for 0.1 or 0.2 at Dmax.

Finally, in processing S7, the above amount of correction is added to the proper Vcont value calculated at processing S4. At this time, needless to say, the minus and plus signs must be included in the amount of correction. When the CPU provides the charger 23 shown in FIG. 2 with control information or one of image the necessary Vcont can be obtained. Then, an image is formed according to the Vcont value.

Figure 7:
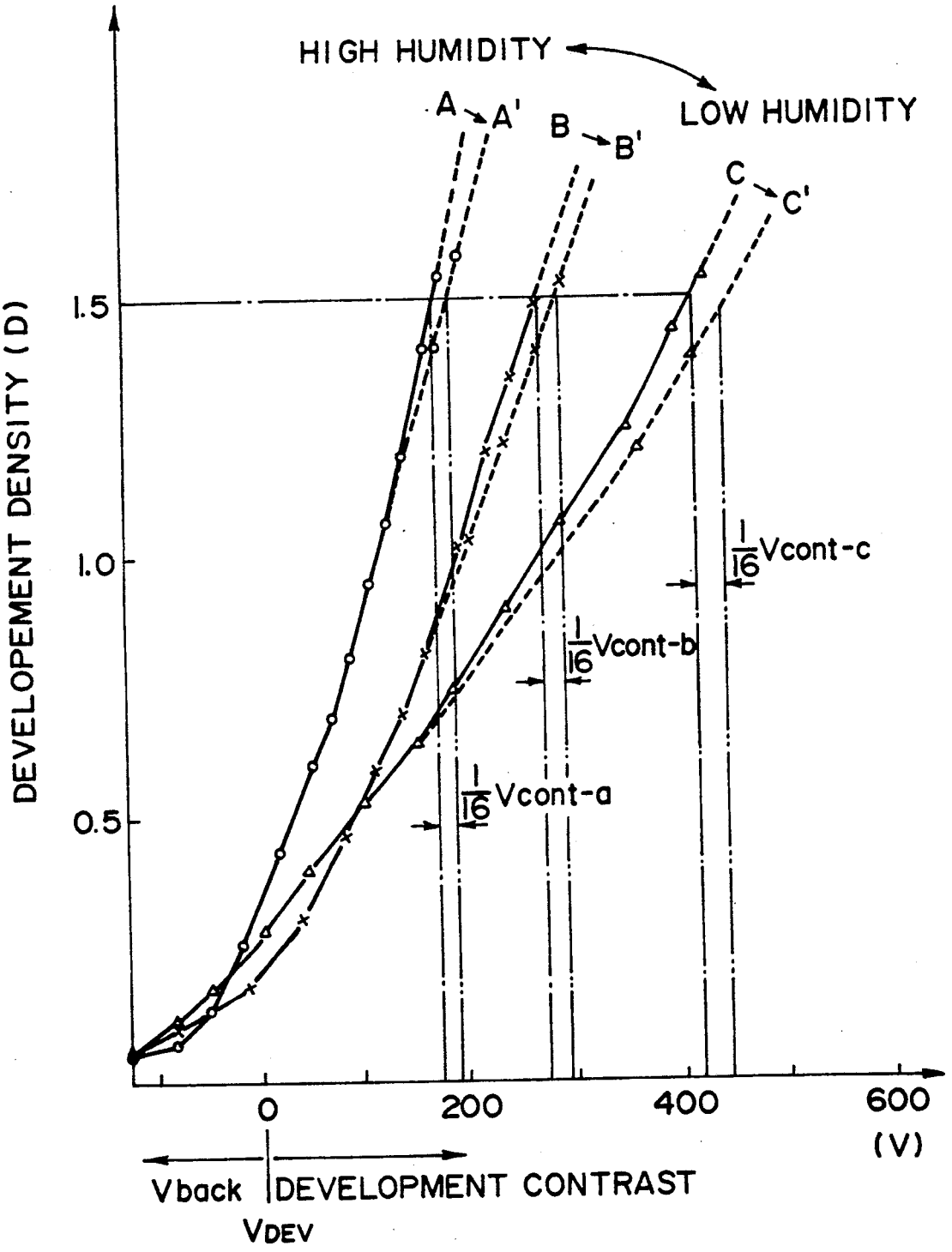
FIG. 7 shows the effects of the correction method of the present invention.

FIG. 7 shows the state of a laser beam printer to which the Vcont correction procedure mentioned above applies.

Figure 5:
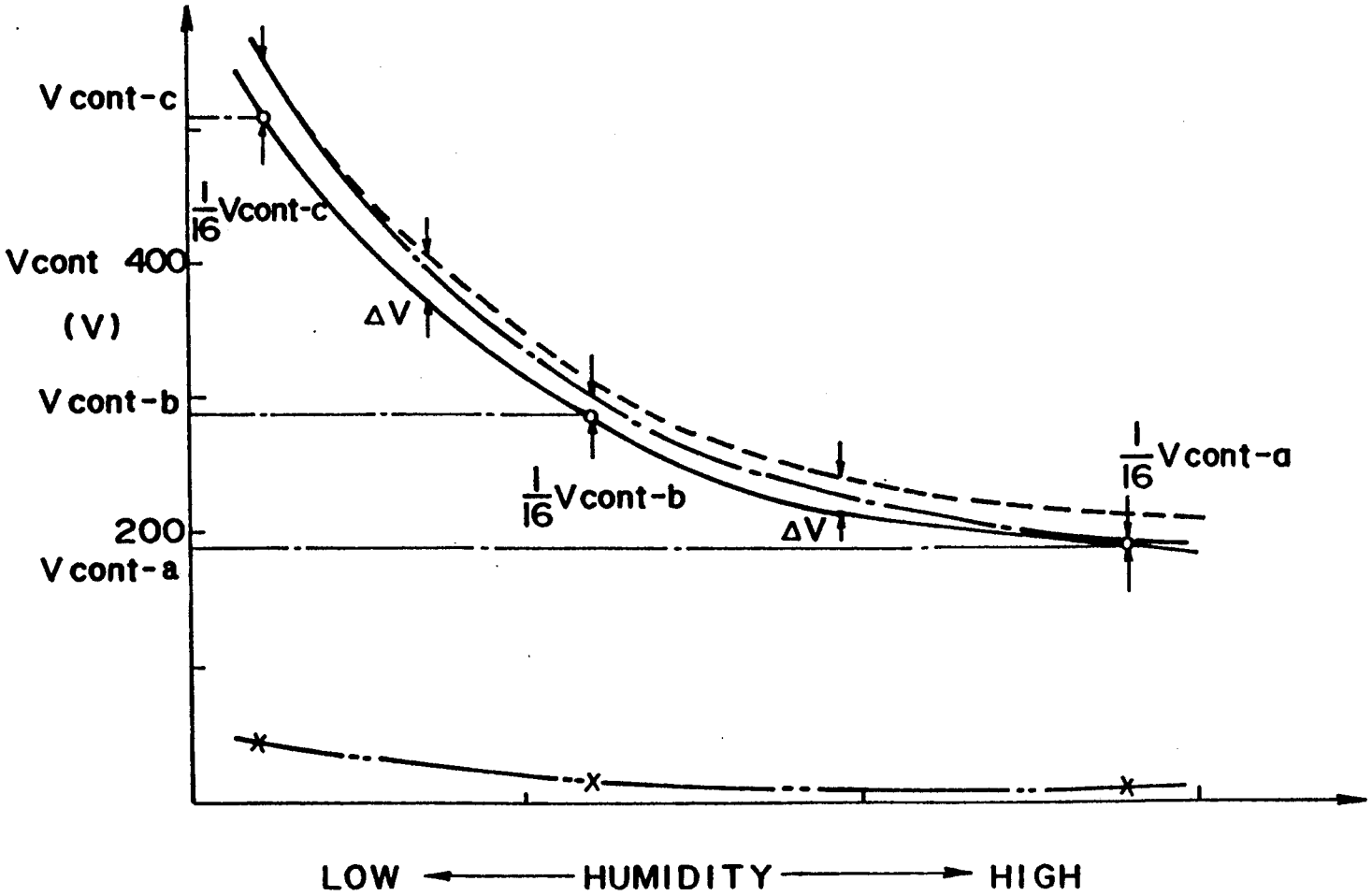
FIG. 5 is a graph indicating the Vcont table for environmental control.
Figure 6:
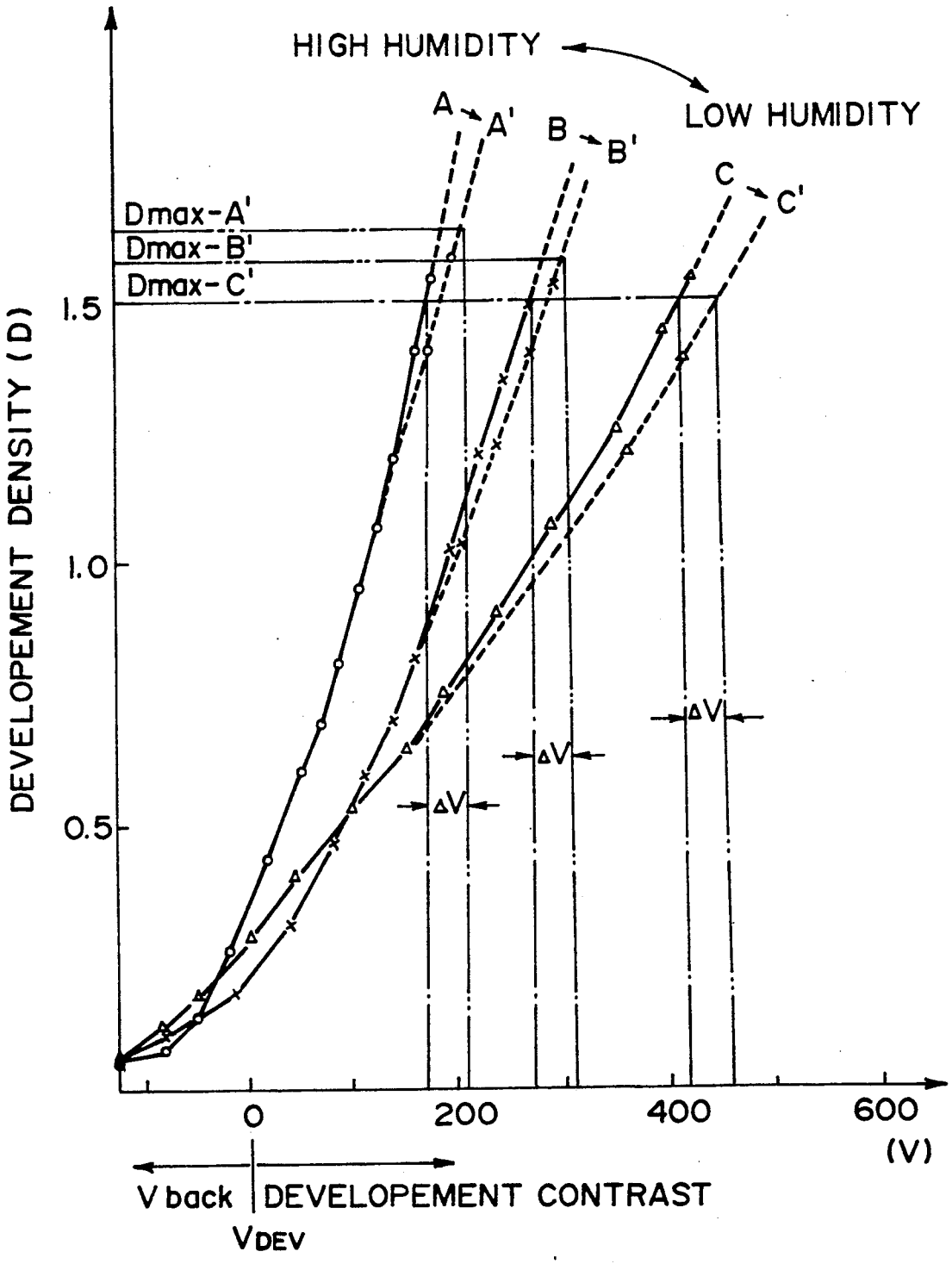
FIG. 6 is a graph indicating variations in the normal development characteristic.

First, it is seen at step of adjustment that Dmax is lower by 0.1 The correction parameter is 1. The environmental states showing the environmental characteristics of A', B', and C' are corrected. Then, the amounts of correction are added to them by 1/16 Vcont-a, 1/16 Vcont-b, and 1/16 Vcont-c, so that the proper Vcont will be Vcont-a+1/16 Vcont-a, Vcont-b+1/16 Vcont-b, and Vcont-c+1/16 Vcont-c. When the Vcont table indicated with the dot-dash line in FIG. 5 is used, correction can be done so properly that Dmax becomes constant at 1.5 in all environments. As a result, constant images can be supplied.

EMBODIMENT 2

The processing sequence shown in FIG. 1 until processing S4 when the proper Vcont is calculated, which has been explained in Embodiment 1, is also applicable to Embodiment 2.

Supposing curves A', B', and C' have more sharp slopes than those shown in FIG. 5, approximation using the certain ratio of Vcont a the amount of unit correction, which is performed in Embodiment 1, will be less reliable.

Therefore, a function expressed with the alternate long and two dashes line in FIG. 5 is designed in advance. Then, the function is stored in memory 13 in FIG. 2, converted into the amount of correction with a correction parameter in the same way as processing S6 in FIG. 1, and then added to the normal Vcont table indicated with the solid line in FIG. 5. Thus, correction can yield the same effects as those for normal curves.

As explained heretofore, when the present invention applies to an image formation system which performs environmental control for development contrast to obtain proper development density according to the amount detected by an environmental detection means in the system, if proper development density cannot be obtained, correction is performed in such a way that the amount of correction to correct development contrast is modified according to the result detected by the environmental detection means. This, even if correction applies to normal environmental control, the development density can remain constant regardless of the environment.

What is claimed is:

1. An image forming apparatus, comprising:
an image supporting member;
means for forming images on said image supporting member;
means for detecting image density;
means for detecting an environmental state;
means for controlling image forming conditions for said image forming means represented by a predetermined value depending on said environmental state; and
means for correcting said predetermined value based on the result detected by said image density detecting means;
wherein the amount of correction of the above correction means varies with said environmental state.

2. An image forming apparatus according to claim 1, wherein said image forming means forms latent images on the image supporting member.

3. An image forming apparatus according to claim 2, wherein said control means controls the difference in potentials of an image and the other non-image portion of a latent image to be formed to be the predetermined value as one of image forming conditions.

4. An image forming apparatus according to claim 2, wherein said image forming means applies development bias voltage to the development means to obtain a toner image from said latent image.

5. An image forming apparatus according to claim 4, wherein said control means controls the difference between the potential at an image of a latent image to be formed and the development bias potential to be the predetermined value as one of image formation conditions.

6. An image forming apparatus according to claim 5, wherein said control means controls the amount of charge in the charging means which charges the image supporting member with electricity.

7. An image forming apparatus according to claim 1, wherein said environmental state is humidity.

8. An image forming apparatus according to claim 7, wherein said humidity is an absolute humidity.

9. An image forming apparatus according to claim 1, wherein said environmental state detecting means detects the inner environmental state of the said system.

10. An image forming apparatus according to claim 7, wherein said amounts of correction vary with the change in humidity.

11. An image forming apparatus according to claim 1, wherein said image density detecting means detects the density of an image formed on the said image supporting member.

12. An image forming apparatus, comprising:
an image supporting member;
means for forming images on said image supporting member;
first detecting means for detecting image density;
second detecting means for detecting an environmental state; and
means for controlling image forming conditions for said image forming means,
wherein said controlling means determines a base value in response to the environmental state detected by said second detecting means, determines a first value for base value correction in response to the environmental state detected by said second detecting means, determines a second value for base value correction in response to the image density detected by said first detecting means, calculates a correcting value based on the first value and second value, and calculates the image forming conditions based on the base value and the correcting value.

13. An image forming apparatus according to claim 12, wherein said image forming means forms electrostatic latent images on said image supporting member.

14. An image forming apparatus according to claim 13, wherein said controlling means controls difference in potentials of image and non-image portions of a latent image to be formed to be a predetermined value as one of the image forming conditions.

15. An image forming apparatus according to claim 13, wherein said image forming means applies development bias potential to development means to obtain a toner image from the latent image.

16. An image forming apparatus according to claim 15, wherein said controlling means controls a difference between the potential at an image of the latent image to be formed and the development bias potential to be a predetermined value as one of the image forming conditions.

17. An image forming apparatus according to any one of claims 12–16, wherein the environmental state is humidity.

18. An image forming apparatus, comprising:
an image supporting member;
means for forming images on said image supporting member;
first detecting means for detecting image density;
second detecting means for detecting humidity; and
means for controlling image forming conditions for said image forming means,
wherein said controlling means determines a base value in response to humidity detected by said second detecting means, determines a unit correcting amount corresponding to the humidity detected by said second detecting means, determines correcting coefficients corresponding to the difference between an intended density and an image density detected by said first detecting means, calculates a correcting value by multiplying the unit correcting amount and the correcting coefficient, and adds the correcting value to the base value.

19. An image forming apparatus according to claim 18, wherein said image forming means forms electrostatic latent images on the image supporting member.

20. An image forming apparatus according to claim 19, wherein said control means controls the difference in potentials of an image and non-image portions of a latent image to be formed to be a predetermined value as one of the image forming conditions.

21. An image forming apparatus according to claim 19, wherein said image forming means applies a development bias potential to the development means to obtain a toner image from said latent image.

22. An image forming apparatus according to claim 21, wherein said controlling means controls the difference between the potential at an image of a latent image to be formed and the development bias potential to be a predetermined value as one of the image forming conditions.

* * * * *